US010808496B2

(12) United States Patent
Zhang et al.

(10) Patent No.: US 10,808,496 B2
(45) Date of Patent: Oct. 20, 2020

(54) CEMENTING PLUG

(71) Applicants: China National Petroleum Corporation, Beijing (CN); CNPC Engineering Technology R&D Company Limited, Beijing (CN); Beijing Petroleum Machinery Co., Beijing (CN)

(72) Inventors: Hongying Zhang, Beijing (CN); Na Wang, Beijing (CN); Yanfu Huang, Beijing (CN); Lin Shi, Beijing (CN); Ping Yu, Beijing (CN)

(73) Assignees: China National Petroleum Corporation, Beijing (CN); CNPC Engineering Technology R&D Company Limited, Beijing (CN); Beijing Petroleum Machinery Co., Beijing (CN)

( * ) Notice: Subject to any disclaimer, the term of this patent is extended or adjusted under 35 U.S.C. 154(b) by 160 days.

(21) Appl. No.: 15/864,716

(22) Filed: Jan. 8, 2018

(65) Prior Publication Data

US 2018/0313186 A1 Nov. 1, 2018

(30) Foreign Application Priority Data

Apr. 28, 2017 (CN) ..... 2017 1 0292040

(51) Int. Cl.
*E21B 33/13* (2006.01)
*E21B 37/02* (2006.01)
(Continued)

(52) U.S. Cl.
CPC ..... *E21B 33/13* (2013.01); *E21B 33/16* (2013.01); *E21B 37/02* (2013.01); *E21B 33/134* (2013.01); *E21B 33/167* (2020.05)

(58) Field of Classification Search
CPC ..... E21B 33/05; E21B 33/12; E21B 33/124; E21B 33/13; E21B 33/134; E21B 33/16
See application file for complete search history.

(56) References Cited

U.S. PATENT DOCUMENTS 2,551,240 A * 5/1951 Bonner ..... E21B 33/134 166/124

FOREIGN PATENT DOCUMENTS

CA 2239748 A1 12/1999
CA 2480371 A1 3/2005
(Continued)

OTHER PUBLICATIONS

On May 28, 2020, accessed the definition of "anchor" at https://www.thefreedictionary.com/anchor (Year: 2004).*
(Continued)

*Primary Examiner* — D. Andrews
*Assistant Examiner* — Manuel C Portocarrero
(74) *Attorney, Agent, or Firm* — Michael Best and Friedrich LLP

(57) ABSTRACT

The present disclosure relates to a cementing plug comprising a first plug body (bottom plug), a second plug body (top plug), and a plurality of cleaning portions. The first plug body comprises: a first body provided therein with a chamber opening towards a lower end thereof, and an upper end of the first body being provided with a pressure portion; and an anti-rotation portion provided on an inner wall of the first body, and capable of being connected to slurry entering the chamber to limit a rotation of the first plug body. The second plug body comprises a second body. The plurality of cleaning portions is provided on outer sidewalls of the first body and the second body along a length direction thereof, for scraping off residuals (mud cake) on an inner wall of a casing.

13 Claims, 6 Drawing Sheets

(51) Int. Cl.
*E21B 33/16* (2006.01)
*E21B 33/134* (2006.01)

(56) References Cited

FOREIGN PATENT DOCUMENTS

| | | | |
|---|---|---|---|
| CN | 200975231 | Y | 11/2007 |
| CN | 201428426 | Y | 3/2010 |
| CN | 202338272 | U | 7/2012 |
| CN | 203050613 | U | 7/2013 |
| CN | 106468154 | A | 3/2017 |
| CN | 206071533 | U | 4/2017 |

OTHER PUBLICATIONS

Chinese Patent Office Action for Application No. 201710292040.1 dated Sep. 19, 2018 (12 pages, English Translation included).
Canadian Patent Office Action for Application No. 2,988,722 dated Sep. 26, 2018 (6 pages).

* cited by examiner

CEMENTING PLUG

CROSS-REFERENCE OF RELATED APPLICATION

This application claims priority to Chinese Patent Application No. 201710292040.1, filed on Apr. 28, 2017, which is hereby incorporated by reference in its entirety.

TECHNICAL FIELD

The present disclosure relates to the field of oil drilling, and particularly, to a cementing plug.

BACKGROUND

In the cementing operation of the oil and gas (including geothermal) drilling process, the cementing plug is usually used for isolating the slurry from the drilling fluid or the spacer fluid. For example, firstly the drilling fluid or the spacer fluid is injected into a casing, and then a cementing plug is placed into the casing; next, the slurry is injected above the cementing plug, so that the cementing plug can isolate the slurry from the drilling fluid or the spacer fluid; and the well cementing operation is completed after the setting of cementing plug.

When the drilling process is required again, the cementing plug and a cement plug isolated below will be cut into chips by a drill bit. The chips are discharged from the wellhead under the effect of circulating drilling fluid, so that the oil and gas channel is clear and smooth.

Currently, in the process of cutting the cementing plug by the drill bit, the cementing plug may be rotate (synchronously or asynchronously) along with the drill bit so it will not be easily broken by the drill bit. Thus, the well cementing operation consumes much time and labor. If the cementing plug cannot be completely broken, the borehole may be easily blocked, which prolongs the time of the well cementing operation, and affects the subsequent operation.

In addition, the outer sidewall of the cementing plug is provided with a substantially bowl-shaped protruding portion for scraping off the drilling fluid, the oil sludge and the slurry on the inner wall of the casing, so that those substances will not remain on the inner wall of the casing, thereby improving the sealability of the cementing plug. But in the prior art, the effect of scraping off residuals (mud cake) on the inner wall of the casing by the cementing plug is not obvious, and the drilling fluid or the slurry still remains on the inner wall of the casing, which affects the well cementing quality at some extent.

SUMMARY OF THE DISCLOSURE

In view of the above problems, an object of the present disclosure is to provide a cementing plug to solve at least one of the above problems.

In order to achieve the above objective, the present disclosure provides a cementing plug comprising a first plug (or say bottom plug) body, a second plug (or say top plug) body, and at least two cleaning portions;

Wherein the first plug body comprises:

a first body provided therein with a chamber opening towards a lower end thereof, an upper end of the first body being provided with a pressure portion, which fractures when subjected to a pressure larger than a predetermined value so that the chamber is in communication with the upper end of the first body;

an anti-rotation portion provided on an inner wall of the first body, and capable of being connected to slurry entering the chamber to limit a rotation of the first plug body;

wherein the second plug body comprises a second body having a lower end connectable to the upper end of the first body, so as to block an upper end of the chamber; and wherein the at least two cleaning portions are provided on outer sidewalls of the first body and the second body, respectively, for scraping off residuals on an inner wall of acasing, the cleaning portion comprising:

at least one first protuberance extending inclinedly upwards relative to a horizontal plane; and at least one second protuberance extending inclinedly downwards relative to the horizontal plane.

In one optional embodiment, the first protuberance is provided along a peripheral direction in a ring shape; and the second protuberances are plural and provided along the peripheral direction at an intervals.

In one optional embodiment, the cleaning portions are plural and provided on the outer sidewalls of the first body and the second body, respectively, along a length direction thereof.

In one optional embodiment, the second protuberances on the cleaning portions adjacent to each other in a longitudinal direction are alternatively provided.

In one optional embodiment, at least part of the second protuberances provided on the first body are projected as a ring shape in the longitudinal direction; and at least part of the second protuberances provided on the second body are projected as a ring shape in the longitudinal direction.

In one optional embodiment, the number of the cleaning portions provided on the first body and/or the second body is three.

In one optional embodiment, the first body comprises a first reinforcing member made of a hard material, located in the chamber, and fixedly connected to the inner wall of the first body, and the anti-rotation portion is provided on an inner wall of the first reinforcing member.

In one optional embodiment, the anti-rotation portion comprises at least one rib provided to extend in a length direction of the first reinforcing member.

In one optional embodiment, the first reinforcing member is tubular, the number of the ribs is three, and the ribs are symmetrically provided with respect to an axial direction of the first reinforcing member.

In one optional embodiment, a lower end of the second body is provided with a guiding portion, and an upper end of the first body is provided with a matching portion matched with the guiding portion of the second body.

In one optional embodiment, an angle between an extending direction of the first protuberance and an extending direction of the second protuberance is larger than 90 degrees and smaller than 180 degrees.

In one optional embodiment, longitudinal cross-sections of the first protuberance and the second protuberance are wing-shaped.

In one optional embodiment, the cleaning portion connected to the first body is integrally formed with the first body, and the cleaning portion connected to the second body is integrally formed with the second body.

In one optional embodiment, the second body further comprises a second reinforcing member made of a metal material and provided in the second body.

In one optional embodiment, one end of the first protuberance is connected to the outer sidewall of the first body and/or the second body, and one end of the second protuberance is connected to a lower side surface of the first protuberance.

In one optional embodiment, one end of the first protuberance is connected to the outer sidewall of the first body and/or the second body, and one end of the second protuberance is connected to the outer sidewall of the first body and/or the second body.

In one optional embodiment, one end of the second protuberance is connected to the outer sidewall of the first body and/or the second body, and one end of the first protuberance is connected to an upper side surface of the second protuberance.

After the slurry is solidified, the anti-rotation portion in the chamber can be connected to the slurry, so as to ensure that the first plug body can be fixedly connected to the slurry and can block the casing, so that when the drill stem drills and destroys the first plug body, the first plug body will not rotate along with the drill stem, which is convenient for the drill stem to break up the first plug body, and avoids the phenomenon in the prior art that the borehole is easily blocked since the cementing plug cannot be thoroughly cut into chips.

With reference to the following descriptions and accompanying drawings, particular embodiments of the present disclosure are disclosed in details to point out the ways in which the principle of the present disclosure is adopted. It shall be appreciated that the range of the embodiments of the present disclosure are not limited thereto. The embodiments of the present disclosure include many changes, modifications and equivalents within the range of the spirit and clauses of the accompanying claims.

BRIEF DESCRIPTIONS OF THE DRAWINGS

In order to more clearly describe the technical solutions in the embodiments of the present disclosure or the prior art, the accompanying drawings to be used in the descriptions of the embodiments or the prior art will be briefly introduced as follows. Obviously, the accompanying drawings in the following descriptions just illustrate some embodiments of the present disclosure, and a person with engineering background can obtain other accompanying drawings from them without paying any creative efforts.

LIST OF REFERENCE SIGNS

1: first plug body (or say bottom plug); 11: first body; 12: chamber; 13: pressure portion; 14: anti-rotation portion; 2: second plug body (or say top plug); 21: second body; 3: cleaning portion; 31: first protuberance; 32: second protuberance; 4: first reinforcing member; 5: second reinforcing member; 6: slurry; 7: drilling fluid.

DETAILED DESCRIPTIONS

Next, the technical solutions of the present disclosure will be described in details with reference to the accompanying drawings and the specific embodiments. After a person with engineering background reads the present disclosure, any equivalent modification made to the present disclosure by that person shall fall within the range defined by the accompanying claims.

To be noted, when an element is referred to as being "provided" on another element, it may be directly located on another element, or there may be an intermediate element. When an element is deemed as being "connected" to another element, it may be directly connected to another element, or there may be an intermediate element. The terms "vertical", "horizontal", "upper", "lower", "left", "right", and the like are used herein just for the purpose of illustration, rather than indicating an unique implementation.

Unless otherwise specified, any technological or scientific term used herein has the same meaning as that generally understood by a person skilled in the technical field of the present disclosure. The terms herein are just used for describing the specific embodiments, rather than restricting the present disclosure. The term "and/or" used herein includes any and all combinations of one or more relevant listed items.

Figure 1:
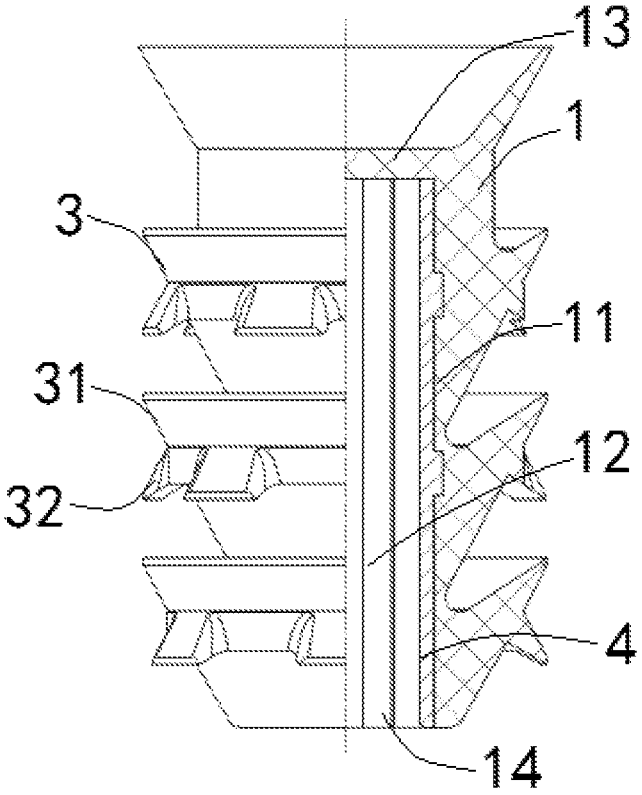
FIG. 1 is a schematic diagram of a cross-sectional structure of a first plug (bottom plug) body provided by an embodiment of the present disclosure.
Figure 2:
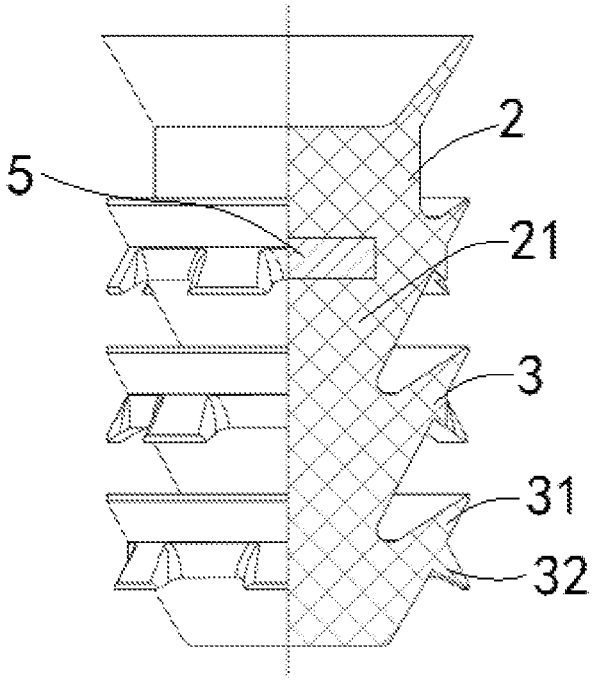
FIG. 2 is a schematic diagram of a cross-sectional structure of a second plug (top plug) body provided by an embodiment of the present disclosure.

As illustrated in FIGS. 1 and 2, an embodiment of the present disclosure discloses a cementing plug comprising a first plug body 1, a second plug body 2, and at least two cleaning portions 3. The first plug body 1 comprises: a first body 11 provided therein with a chamber 12 opening towards a lower end thereof, an upper end of the first body 11 being provided with a pressure portion 13, which fractures when subjected to a pressure larger than a predetermined value so that the chamber 12 is in communication with the upper end of the first body 11; and an anti-rotation portion 14 provided on an inner wall of the first body 11, and capable of being connected to slurry 6 entering the chamber 12 to limit a rotation of the first plug body 1. The second plug body 2 comprises a second body 21 having a lower end connectable to the upper end of the first body 11, so as to block an upper end of the chamber 12. The at least two cleaning portions 3 are provided on outer sidewalls of the first body 11 and the second body 21, respectively, for scraping off residuals on an inner wall of a casing, wherein the cleaning portion 3 comprises at least one first protuberance 31 extending inclinedly upwards relative to a horizontal plane; and at least one second protuberance 32 extending inclinedly downwards relative to the horizontal plane.

In the prior art, an outer wall of the first body 11 or the second body 21 is generally just provided with a protuberance extending upwards. In a process of placing the plug into the casing, the protuberance extending upwards applies an inward extruding force to the plug due to the inner wall of the casing, thus the protuberance constricts inwards, and at that time, a gap is formed between an outer edge of the protuberance extending upwards and the inner wall of the casing. Therefore, the cleaning effect of the cementing plug adopting such a protuberance structure is poor.

Correspondingly, in the embodiment of the present disclosure, the outer wall of the first body 11 or the second body 21 is provided with a first protuberance 31 inclined upwards and a second protuberance 32 inclined downwards. When the cleaning portion 3 moves downwards relative to the inner wall of the casing, an outer edge of the second protuberance 31 is kept in an abutted state to ensure the cleaning effect. After the cleaning process is finished, the first protuberance 31 and the second protuberance 32 may be tightly clung to the inner wall of the casing, so as to seal the casing.

Figure 5:
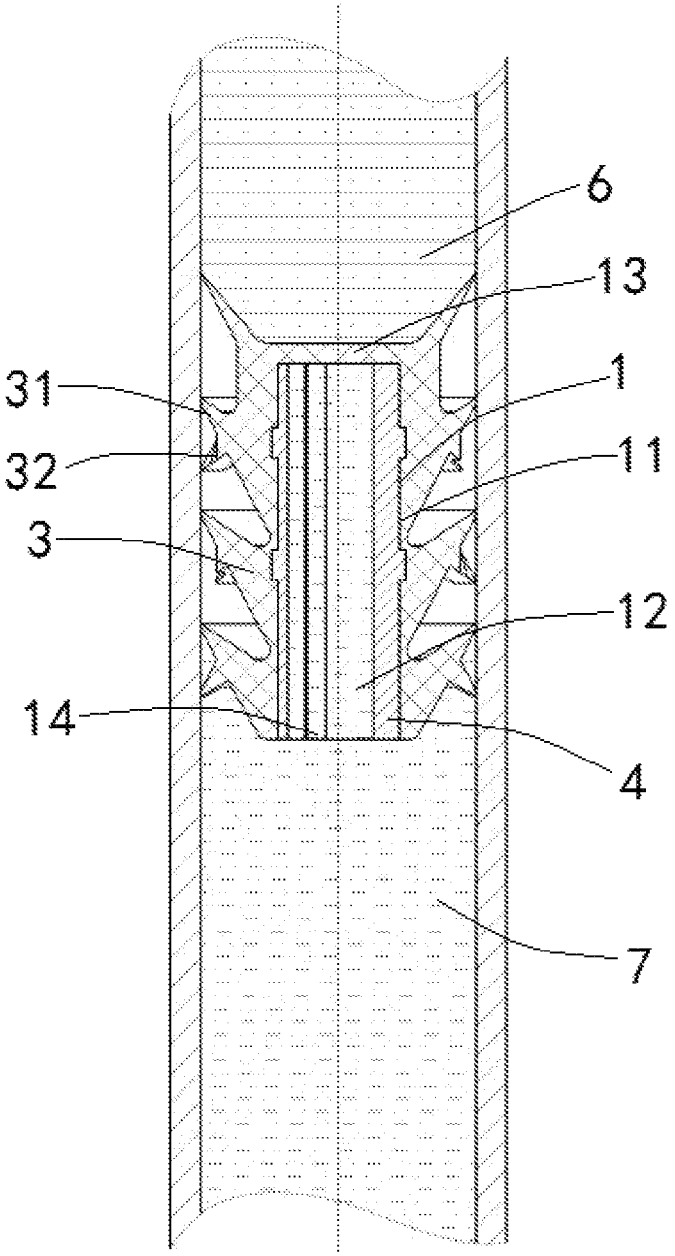
FIG. 5 is a schematic diagram of a structure in which a first plug body provided by an embodiment of the present disclosure is pumped into a casing.

Specifically, in the cementing operation, as illustrated in FIG. 5, the operator may firstly pump the first plug body 1 into the casing, and the cleaning portion 3 on the outer sidewall of the first plug body 1 can scrape off the residuals (drilling fluid 7, oil sludge and slurry 6) on the inner wall of the casing, so as to ensure the smoothness of the inner wall of the casing, while the cleaning portion 3 can be tightly clung to the inner wall of the casing, so as to ensure the sealability of the cementing plug.

When the first plug body 1 is pumped into an appropriate position, slurry 6 may be pumped into the casing. Along with the increase of the pumping pressure, the slurry 6 may burst the pressure portion 13 and enter the chamber 12 of the first plug body 1, if the pressure of the slurry 6 is larger than a maximum pressure bearable to the pressure portion 13. After the slurry 6 is solidified, the anti-rotation portion 14 in the chamber 12 can be connected to the slurry 6, so as to ensure that the first plug body 1 can be fixedly connected to the slurry 6 and can block the casing. When the drill stem drills and destroys the first plug body 1, the first plug body 1 will not be rotated along with the drill stem, which is convenient for the drill stem to destroy the first plug body 1, and avoids the phenomenon in the prior art that the borehole can be easily blocked since the cementing plug cannot be thoroughly cut into chips.

Figure 6:
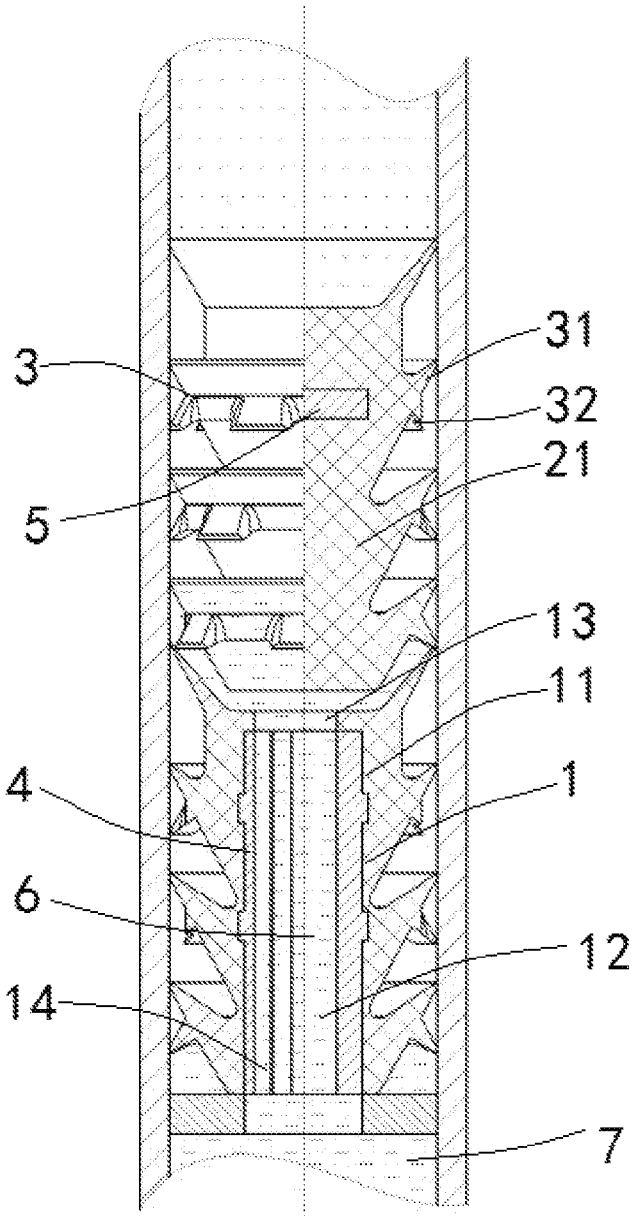
FIG. 6 is a schematic diagram of structures and positions of a first plug body and a second plug body provided by an embodiment of the present disclosure in a working state.

After the first plug body 1 is disposed, as illustrated in FIG. 6, the operator may pump the second plug body 2 to perform a secondary sealing of the casing, thereby preventing the slurry 6 from being pushed out by a drilling fluid 7. The outer sidewall of the second plug body 2 may be provided with a cleaning portion 3 capable of scraping off residuals (drilling fluid 7, oil sludge and slurry 6) on the inner wall of the casing, so as to ensure the smoothness of the inner wall of the casing. The cleaning portion 3 on the second plug body 2 can be further tightly clung to the inner wall of the casing, so as to ensure the sealability of the cementing plug. The lower end of the second plug body 2 can be connected to the upper end of the first plug body 1 through a binding agent such as slurry 6, so as to ensure that the second plug body 2 will not be rotated along with the drill bit due to the position limitation when the drill stem drills and destroys the second plug body 2.

Next, various parts in the cementing plug provided by the embodiment of the present disclosure and the matching modes between those parts will be described with reference to the accompanying drawings, so that a person skilled in the art can implement the present disclosure after reading the following descriptions.

Figure 3:
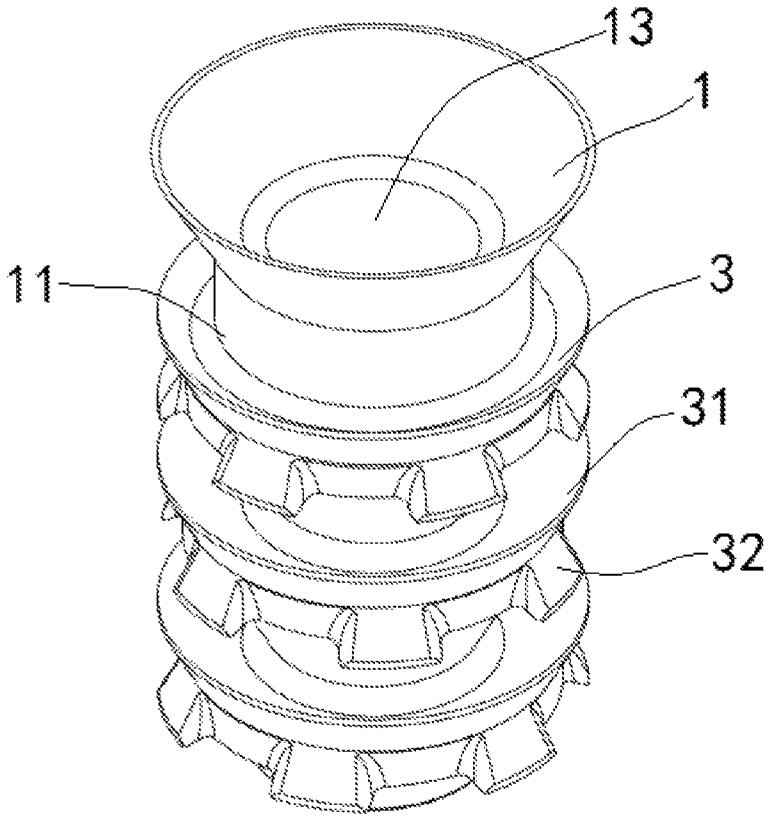
FIG. 3 is a schematic diagram of an overall structure of a first plug body provided by an embodiment of the present disclosure, viewed from a first angle.

As illustrated in FIGS. 1 and 3, the first plug body 1 may comprise a first body 11, wherein the structure of the first body 11 may be various, e.g., the horizontal cross-section of the first body 11 may be substantially shaped as a circular ring, a rectangle, a polygon, or an irregular shape. Preferably, since the horizontal cross-section of the casing is shaped as a circular ring, the structure of the first body 11 may be substantially tubular (the horizontal cross-section is shaped as a circular ring), in order to ensure that the first body 11 is matched with the chamber 12 of the casing.

The first body 11 may be provided therein with a chamber 12. Preferably, the chamber 12 may be substantially cylindrical. The lower end of the first body 11 is opened and communicates with the chamber 12. The upper end of the first body 11 is provided with a pressure portion 13 which may be a rubber film. The film may fracture if the pressure of the pumped slurry 6 reaches a predetermined value, and the slurry 6 enters the chamber 12 from the fracture position of the film.

Specifically, the film may be formed when the first body 11 is machined for the chamber 12. For example, the first body 11 may be made of a plastic material such as rubber. When the first body 11 is machined for the chamber 12, a distance from the upper end of the chamber 12 to the end of the first body 11 may be set. This distance is the thickness of the pressure portion 13, and the pressure subjected to capacity of the pressure portion 13 increases with the thickness, wherein the thickness can be determined based on the specific usage environment during the practical production process, which is not limited in the present disclosure.

After the first plug body 1 is pumped into the casing, the upper end of the first plug body 1 is enclosed before the pressure portion 13 fractures, so as to ensure that the first plug body 1 can seal the casing, and the drilling fluid 7 in the casing will not overflow. The operator may further pump the slurry 6 into the casing, and the slurry 6 applies a pressure to the pressure portion 13. The pressure gradually increases as the slurry 6 is continuously pumped, and the pressure portion 13 will fracture since the born pressure is too large. Thus, the slurry 6 can enter the chamber 12 of the first plug body 1 from the upper end of the first plug body 1. After the slurry 6 entering the chamber 12 is solidified, the first plug body 1 and the slurry 6 seal the casing together, thereby preventing any overflow of the drilling fluid 7 in the casing.

In this embodiment, the first body 11 may be provided on the inner wall thereof with an anti-rotation portion 14 which may be a plurality of protuberances extending radially. The anti-rotation portion 14 may be connected to the slurry 6 solidified in the chamber 12, so as to ensure that the first plug body 1 is connected to the slurry 6 more firmly, wherein the anti-rotation portion 14 is made of a metal or non-metal material (aluminum alloy, aluminum plastic, high-strength plastic, etc.).

In one optional embodiment, the first plug body 1 further comprises a first reinforcing member 4 provided in the chamber 12 and fixedly connected to the first body 11. Specifically, the first reinforcing member 4 may be made of a hard material. For example, the first reinforcing member 4 may be a tubular metal or non-metal (aluminum alloy, aluminum plastic, high-strength plastic, etc.) member.

Of course, the first reinforcing member 4 may have other shapes. For example, the shape of the first reinforcing member 4 may be determined from the shape of the chamber 12, so as to ensure that the first reinforcing member 4 can be sleeved in the first body 11, and the outer sidewall of the first reinforcing member 4 can be fixedly connected to an interior of the first body 11.

The first reinforcing member 4 can be fixedly connected to the first body 11 in such a way that several protruding portions are provided on the outer sidewall of the first reinforcing member 4. The inner wall of the first body 11 may be provided with grooves matched with the protruding portions. The protruding portions may be matched with the grooves so that the first reinforcing member 4 can be fixedly connected to the first body 11. During the practical production, the first body 11 may be made of a rubber material, so that the first body 11 can be molded over the first reinforcing member 4 or formed by directly wrapping over the first reinforcing member 4 with a layer of rubber material, so that the first body 11 can be fixedly connected to the first reinforcing member 4.

Figure 4:
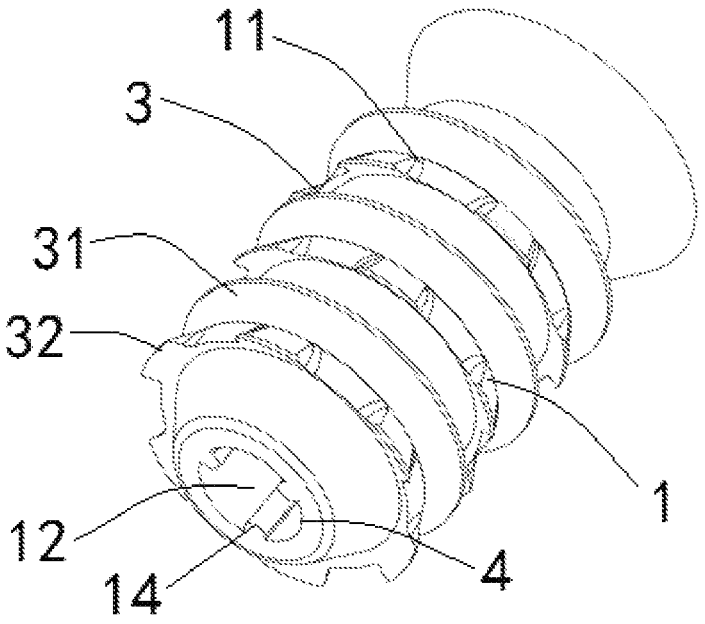
FIG. 4 is a schematic diagram of an overall structure of a first plug body provided by an embodiment of the present disclosure, viewed from a second angle.

As illustrated in FIG. 4, when the first body 11 is provided therein with the first reinforcing member, the anti-rotation portion 14 may be at least one rib provided on the inner wall of the first reinforcing member 4, and the rib is extendable in a length direction of the first reinforcing member 4.

Specifically, the length of the rib may be adaptive to the length of the first reinforcing member 4. When the slurry 6 is injected into the chamber 12 of the first body 11, the first reinforcing member 4 is also filled with the slurry 6. The rib may be embedded into the solidified slurry 6, so as to ensure that the first body 11 is fixedly connected to the slurry 6. In order to ensure the connection strength between the first reinforcing member 4 and the slurry 6, preferably, there may be three ribs which can be symmetrically provided with respect to the axial direction of the first reinforcing member 4.

The residuals such as drilling fluid 7, oil sludge, slurry 6, etc. generally remain on the inner wall of the casing. When the cementing plug is provided in the casing or the slurry 6 is injected into the casing, the cementing plug or the solidified slurry 6 cannot be well contacted with the inner wall of the casing since the residuals remain on the inner wall of the casing. Thus, the friction force between the cementing plug or the solidified slurry 6 and the inner wall of the casing is small. When the pressure of the drilling fluid 7 in the casing is higher than a certain value, the drilling fluid 7 may push the cementing plug or the slurry 6 away, and then the well cementing effect is injured.

In view of the above problem, in this embodiment, the first body 11 may be provided with a plurality of cleaning portions 3 which can be arranged on the outer sidewall of the first body 11 along the length direction of the first body 11, so as to scrape off the residuals on the inner wall of the casing, thereby ensuring the cleanness of the inner wall of the casing.

As illustrated in any one of FIGS. 1 to 4, a plurality of cleaning portions 3 are provided on the outer sidewalls of the first body 11 and the second body 21, respectively, along the length direction thereof.

In this embodiment, when the first body 11, the second body 21, and the cleaning portion 3 are made of plastic materials such as rubber, the cleaning portion 3 connected to the first body 11 may be integrally formed with the first body 11. The cleaning portion 3 connected to the second body 21 may also be integrally formed with the second body 21.

Specifically, the cleaning portion 3 may comprise a first protuberance 31 and a second protuberance 32. The first protuberance 31 may extend inclinedly upwards relative to a horizontal plane, wherein the horizontal plane may be a plane perpendicular to the first body 11 in a use state. The second protuberance 32 may extend inclinedly downwards relative to the horizontal plane. An angle between an extending direction of the first protuberance 31 and an extending direction of the second protuberance 32 may be larger than 90 degrees and smaller than 180 degrees.

In this embodiment, as illustrated in FIGS. 3 and 4, the first protuberance 31 may be provided continuously along a peripheral direction of the first body 11, i.e., the first protuberance 31 may be substantially a rubber bowl-shaped structure that sleeves the first body 11. There may be a plurality of second protuberances 32 which are provided below the first protuberance 31, arranged along the peripheral direction of the first body 11 and spaced from each other at a predetermined distance.

When the first protuberance 31 and the second protuberance 32 are both continuous structures, their peripheries are tightly clung to the inner wall of the casing. The first plug body 1 encounters a large resistance when it is pumped into the casing, and the pumping is inconvenient. Thus, the second protuberances 32 may be provided as being spaced from each other, i.e., openings are formed between the second protuberances 32, and when the first plug body 1 is placed downwards, the gas below the first plug body 1 will be discharged through the openings, which ensures that the resistance caused by the gas pressure is small when the first plug body 1 is placed downwards.

In one optional embodiment, as illustrated in FIG. 1, the longitudinal cross-sections of the first protuberance 31 and the second protuberance 32 may be wing-shaped (triangular structures). Meanwhile, the first protuberance 31 and the second protuberance 32 may be made of an elastic material such as rubber, so that they can be deformed at certain extent. When the cleaning portion 3 cleans the inner wall, the first protuberance 31 and the second protuberance 32 can abut against the inner wall of the casing, which is convenient to scrape off the residuals on the inner wall of the casing. After the cleaning is finished, the first protuberance 31 and the second protuberance 32 can be tightly clung to the inner wall of the casing, thereby ensuring the sealability of the cementing plug.

As illustrated in FIG. 4, when a plurality of second protuberances 32 are provided as being spaced from each other, there is an opening between two second protuberances 32 in the same peripheral direction. In order to ensure that the second protuberances 32 can scrape off the residuals, the second protuberances 32 on adjacent cleaning portions 3 are alternatively provided in the longitudinal direction. For example, regarding an upper second protuberance 32 and a lower second protuberance 32 adjacent to each other, the upper second protuberance 32 may be provided at a position where the lower second protuberance 32 has an opening, so as to ensure that the upper second protuberance 32 can eliminate the residuals which cannot be scraped off by the lower second protuberance 32.

Preferably, at least part of the second protuberances 32 provided on the first body 11 is projected as a ring shape in the longitudinal direction, i.e., the second protuberances 32 provided on the cleaning portion 3 can completely cover the inner wall of the casing, so as to prevent the problem that the residuals on the inner wall of the casing cannot be thoroughly scraped off.

In this embodiment, the relative positions of the first protuberance 31 and the second protuberance 32 may be various. For example, the first protuberance 31 may be provided on the first body 11, i.e., the end of the first protuberance 31 is connected to the outer sidewall of the first body 11. The second protuberance 32 may be provided on the outer sidewall of the first protuberance 31 facing downwards.

In another example, both the first protuberance 31 and the second protuberance 32 can be provided on the first body 11, i.e., the ends of the first protuberance 31 and the second protuberance 32 are both connected to the outer sidewall of the first body 11, and the first protuberance 31 is located above the second protuberance 32.

In still another example, the second protuberance 32 may be provided on the first body 11, i.e., the end of the second protuberance 32 is connected to the outer sidewall of the first body 11, and the first protuberance 31 may be provided on the outer sidewall of the second protuberance 32 facing upwards.

In one optional embodiment, the number of the cleaning portions 3 may be three, and each of the cleaning portions 3 is provided in the length direction of the first body 11.

In this embodiment, as illustrated in FIG. 2, the second plug body 2 may comprise a second body 21, wherein the structure of the second body 21 may be various. For example, the horizontal cross-section of the second body 21 may be substantially shaped as a circular ring, a rectangle, a polygon or an irregular shape.

Since the horizontal cross-section of the casing is substantially shaped as a circular ring, preferably, the structure of the second body 21 may be substantially tubular (the horizontal cross-section is shaped as a circular ring), so as to ensure that the second body 21 is matched with the chamber 12 of the casing, and then seal the sleeve. In order to ensure the sealability of the second plug body 2, the second body 21 may be made of a rubber material, thereby ensuring that the second plug body 2 can be deformed at certain extent, so as to block a gap that might be existed between the second body 21 and the inner wall of the casing, and then improve the sealability of the second plug body 2.

The second body 21 may be provided with a plurality of cleaning portions 3 which are arranged on the outer sidewall of the second body 21 along the length direction of the second body 21, for scraping off the residuals on the inner wall of the casing, thereby ensuring the cleanness of the inner wall of the casing. The structures and arrangement modes of the first protuberance 31 and the second protuberance 32 in the cleaning portion 3 are the same as those of the cleaning portion 3 provided on the first body 11, and a person skilled in the art can implement them with reference to the cleaning portion 3 provided on the first body 11, the description of which is omitted herein.

In one optional embodiment, the number of the cleaning portions 3 may be three, and each of the cleaning portions 3 is provided in the length direction of the second body 21.

In this embodiment, the second body 21 is further provided therein with a second reinforcing member 5 which may be made of a metal material or a non-metal hard material (aluminum alloy, aluminum plastic, high-strength plastic, etc.)

In this embodiment, the lower end of the second body 21 may be provided with a guiding portion, and the upper end of the first body 11 may be provided with a matching portion matched with the guiding portion of the second body 21. The guiding portion may be a diameter-variable portion where the diameter continuously decreases from top to bottom. The matching portion may be an opening portion having the chamber 12 adaptive to the shape of the diameter-variable portion, so that the guiding portion and the matching portion are adaptive to each other. Meanwhile, a certain space is formed between the matching portion and the guiding portion. The slurry 6 may be located in the space, so as to ensure that the first body 11 and the second body 21 can be connected to each other.

All of the disclosed articles and references, including the patent applications and publications, are incorporated herein by reference for various purposes. The term "substantially composed of . . . " describing a combination shall include the determined elements, compositions, components or steps, and other elements, compositions, components or steps substantively not influencing the basic novelty feature of the combination. When describing the combination of the elements, compositions, components or steps herein with the term "including" or "comprising", embodiments substantially constituted by those elements, compositions, components or steps are also considered. The term "may" herein intends to indicate that any described attribute concerned by "may" is optional.

A plurality of elements, compositions, components or steps can be provided by a single integrated element, composition, component or step. Alternatively, a single integrated element, composition, component or step may also be divided into separate elements, compositions, components or steps. The wording "an" or "one" used for describing the element, composition, component or step does not exclude other elements, compositions, components or steps.

It shall be appreciated that the above descriptions are made for illustration rather than restriction. After reading the above descriptions, many embodiments and applications besides the provided examples will be obvious for a person skilled in the art. Thus, the range of the teaching shall not be determined with reference to the above descriptions, but with reference to the range of the accompanying claims and their equivalents. For the purpose of comprehensiveness, all of the articles and references, including the patent applications and announced publications, are incorporated herein by reference. Any aspect in the aforementioned claims which omits the subject matter disclosed herein does not intend to waive the content of the subject matter, and it also shall not be deemed that the inventor does not consider this subject matter as a part of the subject matter of the invention disclosed.

The invention claimed is:

1. A cementing plug, comprising a first plug body, a second plug body, and at least two cleaning portions;

wherein the first plug body comprises:

a first body provided therein with a chamber opening towards a lower end thereof, an upper end of the first body being provided with a pressure portion, which fractures when subjected to a pressure larger than a predetermined value so that the chamber is in communication with the upper end of the first body; and an anti-rotation portion provided on an inner wall of the first body, and capable of being connected to slurry entering the chamber so as to limit rotation of the first plug body;

the first body comprises a first reinforcing member made of a hard material, located in the chamber and fixedly connected to the inner wall of the first body, and the anti-rotation portion is provided on an inner wall of the first reinforcing member;

wherein the second plug body comprises a second body having a lower end connectable to the upper end of the first body, so as to block an upper end of the chamber; and wherein the at least two cleaning portions are provided on outer sidewalls of the first body and the second body, respectively, for scraping off residuals on an inner wall of a casing, the cleaning portions are plural and provided on the outer sidewalls of the first body and the second body, respectively, along a length direction thereof, wherein the cleaning portion comprises:

at least one first protuberance extending inclinedly upwards relative to a horizontal plane, the first protuberance is provided along a peripheral direction in a ring shape;

at least one second protuberance extending inclinedly downwards relative to the horizontal plane, the second protuberances are plural and provided along the peripheral direction at intervals, the second protuberances on the cleaning portions adjacent to each other in a longitudinal direction are alternatively provided.

2. The cementing plug according to claim 1, wherein at least part of the second protuberances provided on the first body are projected as a ring shape in the longitudinal direction; and at least part of the second protuberance provided on the second body are projected as a ring shape in the longitudinal direction.

3. The cementing plug according to claim 1, wherein the number of the cleaning portions provided on the first body and/or the second body is three.

4. The cementing plug according to claim 1, wherein the anti-rotation portion comprises at least one rib provided to extend in a length direction of the first reinforcing member.

5. The cementing plug according to claim 4, wherein the first reinforcing member is tubular, the number of the ribs is three, and the ribs are symmetrically provided with respect to an axial direction of the first reinforcing member.

6. The cementing plug according to claim 1, wherein a lower end of the second body is provided with a guiding portion, and an upper end of the first body is provided with a matching portion matched with the guiding portion of the second body.

7. The cementing plug according to claim 1, wherein an angle between an extending direction of the first protuberance and an extending direction of the second protuberance is larger than 90 degrees and smaller than 180 degrees.

8. The cementing plug according to claim 1, wherein longitudinal cross-sections of the first protuberance and the second protuberance are wing-shaped.

9. The cementing plug according to claim 1, wherein the cleaning portion connected to the first body is integrally formed with the first body, and the cleaning portion connected to the second body is integrally formed with the second body.

10. The cementing plug according to claim 1, wherein the second body further comprises a second reinforcing member made of a metal material and provided in the second body.

11. The cementing plug according to claim 1, wherein one end of the first protuberance is connected to the outer sidewall of the first body and/or the second body, and one end of the second protuberance is connected to a lower side surface of the first protuberance.

12. The cementing plug according to claim 1, wherein one end of the first protuberance is connected to the outer sidewall of the first body and/or the second body, and one end of the second protuberance is connected to the outer sidewall of the first body and/or the second body.

13. The cementing plug according to claim 1, wherein one end of the second protuberance is connected to the outer sidewall of the first body and/or the second body, and one end of the first protuberance is connected to an upper side surface of the second protuberance.

* * * * *